United States Patent [19]

Bates et al.

[11] Patent Number: 4,853,050

[45] Date of Patent: Aug. 1, 1989

[54] OIL-IN-WATER EXPLOSIVE COMPOSITION CONTAINING ASPHALT

[75] Inventors: Andrew Bates; Vladimir Sujansky, both of Victoria, Australia

[73] Assignee: Ici Australian Operators Pty Ltd., Victoria, Australia

[21] Appl. No.: 248,717

[22] Filed: Sep. 23, 1988

[30] Foreign Application Priority Data

Sep. 23, 1987 [AU] Australia ..... PI4556

[51] Int. Cl.[4] ..... C06B 15/00

[52] U.S. Cl. ..... 149/2; 149/46; 149/60; 149/61; 149/70; 149/76; 149/83; 149/109.6

[58] Field of Search ..... 149/2, 109.6, 46, 61, 149/76, 70, 83, 60

[56] References Cited

U.S. PATENT DOCUMENTS 4,111,727 9/1978 Clay ..... 149/2

4,448,619 5/1984 Mitchell ..... 149/2

4,594,118 6/1986 Curtin et al. ..... 149/2

*Primary Examiner*—Stephen J. Lechert, Jr.

*Attorney, Agent, or Firm*—Cushman, Darby & Cushman

[57] ABSTRACT

This invention relates to a method of producing a composition comprising solid particulate ammonium nitrate having improved explosive properties.

Explosive compositions comprising particulate ammonium nitrate such as ANFO, which is a mixture of particulate ammonium nitrate and about 6% w/w of a fuel oil which is typically distillate oil, have been known for many years as relatively inexpensive and reliable explosives.

Despite the wide acceptance of particulate ammonium nitrate based explosives in the industry, their use has been limited by their relatively poor performance in wet conditions; in such conditions, explosive power can be seriously reduced, and they can be difficult to detonate.

27 Claims, No Drawings

OIL-IN-WATER EXPLOSIVE COMPOSITION CONTAINING ASPHALT

This invention relates to a method of producing a composition comprising solid particulate ammonium nitrate having improved explosive properties.

Explosive compositions comprising particulate ammonium nitrate such as ANFO, which is a mixture of particulate ammonium nitrate and about 6% w/w of a fuel oil which is typically distillate oil, have been known for many years as relatively inexpensive and reliable explosives.

Despite the wide acceptance of particulate ammonium nitrate based explosives in the industry, their use has been limited by their relatively poor performance in wet conditions; in such conditions, explosive power can be seriously reduced, and they can be difficult to detonate.

Blends Of particulate ammonium nitrate (eg. ANFO) and water-in-oil emulsion explosives have been used widely in the industry.

Although the overall performance of this product in wet conditions is improved, the use of the emulsion explosive significantly increases the cost of the product. Furthermore, the performance of the product in water-containing boreholes is not significantly improved unless a high proportion of emulsion explosive is used.

Attempts have been made to improve the performance of particulate ammonium nitrate by coating the surface of the particles with a melt of a polymer such as a polyurethane. Although some improvement in water resistance is provided by such coatings, small imperfections in the coating allow dissolution of ammonium nitrate within the particle. Furthermore, coating techniques such as this require specialised equipment which cannot easily be used at a blasting site.

We have now developed a method of producing a particulate ammonium nitrate explosive which has excellent explosive properties even in wet conditions.

Accordingly we provide a method of preparing a particulate ammonium nitrate composition having improved explosive properties in wet conditions the method comprising contacting ammonium nitrate particles with an oil-in-water emulsion wherein the discontinuous phase comprises asphalt.

It is well known that asphalts come in the form of solids, semi-solids and liquids. The use of the term oil-in-water emulsion is meant to describe two phase colloidal systems wherein the asphalt is dispersed in an aqueous dispersing medium.

Preferably said ammonium nitrate particles are blended with an oil-in-water composition in the ratio of 100 parts of ammonium nitrate particles to from 1 to 40 parts by weight and preferably 1 to 20 parts by weight of asphalt.

Preferably the oil-in-water emulsion component will comprise in the range 1 to 90% w/w of said asphalt fuel, preferably 5 to 80% and more preferably 40 to 70% w/w.

The continuous aqueous phase of the oil-in-water emulsion component may optionally further comprise an aqueous solution of one or more inorganic nitrates such as for example ammonium nitrate and/or calcium nitrate. Such an aqueous phase is particularly advantageous where it is desired to increase the bulk density of the ammonium nitrate particles. The aqueous phase may for example comprise in the range of from 1 to 80% by weight of inorganic nitrates, preferably 5 to 70% more preferably 20 to 60%.

It is particularly preferred that the discontinous oil phase of the oil-in-water emulsion component comprises at least 50% by weight of an asphalt and we have found that good results are obtained when the oil phase consists substantially of asphalt.

However, if desired, other oils such as for example distillate or fuel oil may be present in the oil phase.

Asphalt is defined by ASTM Designation D8 (1976) as a dark brown to black cementitious material in which the predominating constituents are bitumens that occur in nature or are obtained in petroleum processing. The term bitumen is commonly used as a synonym for asphalt.

While all asphalts are useful in providing a method of producing a particulate ammonium nitrate explosive which has excellent explosive properties even in wet conditions, it is preferred that asphalts which are solid or semisolid at ambient temperatures be used. These appear to provide particulate ammonium nitrate explosives with even greater resistance to degredation of explosive properties in wet conditions.

Without wishing to be bound by theory the diffusion of water into the explosive appears to decrease as the viscosity of the asphalt increases. For this reason it is preferred that asphalt which is solid at ambient temperatures be used.

Further the preparation of oil-in-water emulsions is facilitated by asphalts with melting temperatures just above ambient temperature. Such low melting temperature asphalts allow emulsions to be formed without substantial heating.

The product derived from our process has a significantly improved performance in wet conditions when compared to conventional ANFO.

Without wishing to be bound by theory we believe that the improvement in explosive performance may be due to the strong association of the asphalt particles with the ammonium nitrate surface, which is brought about using our process.

Apparently the oil-in-water emulsion breaks down on contact with the particulate ammonium nitrate with the aqueous phase being rapidly absorbed, leaving asphalt deposited at or near the surface of the particles, and without wishing to be bound by theory, we believe that the rapid absorption of the aqueous phase of the emulsion by the hydrophilic ammonium nitrate surface results in the formation of a strong bond between the oil phase and the surface ammonium nitrate particles.

The nature of the emulsifying agent present in the oil-in-water emulsion is not narrowly critical; we believe this is because its function is merely to provide an emulsion of the asphalt fuel until the blending with the ammonium nitrate. Hence the emulsifying agent will conveniently be chosen to provide an oil-in-water emulsion which will remain in the emulsion form until use.

Emulsifiers may be chosen from the range of anionic, cationic and nonionic surfactants, having regard to the nature of oil component to be emulsified.

For example, commonly-used surfactants are anionic sodium palmitate and cationic N-octadecyl-1,3-propane diamine hydrochloride. Anionic emulsifiers include an inorganic salt, eg., the sodium or potassium salt of a fatty acid wherein the fatty acid may optimally be a mixture containing one or more of palmitic, stearic, linoleic, oleic and abietic acids and higher molecular weight phenols. We have found cationic emulsifiers particularly useful emulsifiers in the method of the present invention. The emulsion component may also comprise further additives, for example, emulsion stabilisers such as sodium lignate or viscosity modifying agents such as nonionic cellulose derivatives. Examples of preferred emulsifiers include sodium stearate, the zinc-tall oil reaction product with oleic acid amide and ethylene oxide fatty secondary amine condensates.

Emulsifiers may also be formed in situ, for example, by using alkali to form naphthaleneate soaps from free naphthalenic acids commonly present in asphalt.

The setting time of the oil-in-water emulsion is dependant on a number of factors. These factors include the composition of the emulsion and the temperature at which the emulsion is contacted with the particulate ammonium nitrate. Selection of setting times required for specific applications may determined without undue experimentation.

The oil-in-water emulsion phase may be combined with the ammonium nitrate by spraying; however, we have found it to be convenient simply to blend the emulsion and solid ammonium nitrate components.

Blending may be carried out using conventional mechanical mixers, and we have found rotary drum mixers of the type used for mixing concrete to be particularly convenient for largescale operations.

The temperature at which the emulsion components is combined with the solid ammonium nitrate particles will depend on the nature of the chosen oil phase. Typically the temperature will be in the range 0° to 80° C. It may be advantageous in some cases to heat the emulsion phase to soften the oil component. However, in general we have found that it is convenient to carry out the process at ambient temperature.

The ammonium nitrate particles coated according to the process hereinbefore described may be used in the preparation of blends with water-in-oil emulsion explosives.

For example blends of a water-in-oil emulsion explosive and ammonium nitrate (or ANFO) are described in Australian Patent Application No. 29408/71 (Butterworth) and U.S. Pat. Nos. 3 161 551 (Egly et al), 4 111 727 Clay and 4 357 184 (Binet et al).

A serious problem suffered by prior art blends is their tendency to break up on contact with water, resulting in dissolution of solid ammonium nitrate and a significant reduction in sensitivity to detonation.

This problem is particularly serious where the blend comprises a significant proportion of ammonium nitrate, for example, at least 40% by weight.

Accordingly, in a further embodiment of the present invention, we provide an explosive composition comprising a mixture of a water-in-oil emulsion component and a particulate ammonium nitrate component characterised in that the particulate ammonium nitrate component comprises ammonium nitrate particles which have been coated with an oil-in-water emulsion wherein the discontinuous, water-immiscible, oil phase of the oil-in-water emulsion comprises asphalt.

Preferably the explosive composition comprises in the range 5 to 95% w/w of coated ammonium nitrate particles, more preferably 30 to 80%, and most preferably 40 to 60% w/w.

It will be apparent to those skilled in the art that the nature of the water-in-oil emulsion component is not narrowly critical to the present invention. The advantages provided by combining the coated ammonium nitrate particles of the present invention with a water-in-oil emulsion giving an explosive composition with improved explosive properties in wet conditions are achievable using oil-in-water emulsions available to those skilled in the art.

Typically oil-in-water emulsions of use in this embodiment of the present invention comprise a discontinuous aqueous phase comprising at least one oxygen releasing salt, a continuous water-immiscible organic phase and a water-in-oil emulsifying agent.

Suitable oxygen-releasing salts for use in the aqueous phase component of the water-in-oil emulsion explosive component include the alkali and alkaline earth metal nitrates, chlorates and perchlorates, ammonium nitrate, ammonium chlorate, ammonium perchlorate and mixtures thereof. The preferred oxygen-releasing salts include ammonium nitrate. More preferably the oxygen-releasing salt comprises ammonium nitrate or a mixture of ammonium nitrate and sodium or calcium nitrates.

Typically, the oxygen-releasing salt component of the emulsion compositions comprises from 45 to 95% and preferably from 60 to 90% by weight of the total composition. In compositions wherein the oxygen-releasing salt comprises a mixture of ammonium nitrate and sodium nitrate, the preferred composition range for such a blend is from 5 to 80 parts of sodium nitrate for every 100 parts of ammonium nitrate. Therefore, preferably the oxygen-releasing salt component comprises from 45 to 90% by weight (of the total emulsion component) ammonium nitrate or mixtures of from 0 to 40% by weight (of the total composition) ammonium nitrate.

In the emulsion explosive component of the compositions preferably all of the oxygen-releasing salt is in aqueous solution. Typically, the amount of water employed in the compositions is in the range of from 1 to 30% by weight of the emulsion component. Preferably the amount employed is from 5 to 25%, and more preferably from 6 to 20%, by weight of the emulsion component.

The continuous water-immiscible organic phase component of the emulsion composition comprises the continuous "oil" phase of the water-in-oil emulsion explosive and acts as a fuel. Suitable organic fuels include aliphatic, alicyclic and aromatic compounds and mixtures thereof which are in the liquid state at the formulation temperature. Suitable organic fuels may be chosen from fuel oil, diesel oil, distillate, kerosene, naphtha, waxes, (e.g. microcrystalline wax, paraffin wax and slack wax), paraffin oils, benzene, toluene, xylenes, polymeric oils such as the low molecular weight polymers of olefins, animal oils, fish oils, and other mineral, hydrocarbon or fatty oils, and mixtures thereof. Preferred organic fuels are the liquid hydrocarbons generally referred to as petroleum distillates such as gasoline, kerosene, fuel oils and paraffin oils.

Typically, the organic fuel or continuous phase of the water-in-oil emulsion explosive component comprises from 2 to 15% by weight and preferably 3 to 10% by weight of the emulsion component of the composition.

The water-in-oil emulsifying agent component of the composition of the emulsion phase may be chosen from the wide range of emulsifying agents known in the art to be suitable for the preparation of water-in-oil emulsion explosive compositions. Examples of such emulsifying agents include alcohol alkoxylates, phenol alkoxylates, poly(oxyalkylene) glycols, poly(oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly- (oxyalkylene) glycol esters, fatty acid amides, fatty acid amide alkoxylates, fatty amines, quaternary amines, alkyloxazolines, alkenyloxazolines, imidazolines, alkylsulfonates, alkylarylsulfonates, alkylsulfosuccinates, alkylphosphates, alkenylphosphates, phosphate esters, lecithin, copolymers of poly(oxyalkylene) glycols and poly(12-hydroxystearic acid), and mixtures thereof. Among the preferred emulsifying agents are the 2-alkyl- and 2-alkenyl-4,4'-bis (hydroxymethyl) oxazoline, the fatty acid esters of sorbitol, lecithin, copolymers of poly(oxyalkylene) glycols and poly(12-hydroxystearic acid), and mixtures thereof, and particularly sorbitan mono-oleate, sorbitan sesquioleate, 2-oleyl-4,4'-bis (hydroxymethyl) oxazoline, mixture of sorbitan sesquioleate, lecithin and a copolymer of poly(oxyalkylene glycol and poly (12-hydroxystearic acid), and mixtures thereof.

Typically, the emulsifying agent component of the composition comprises up to 5% by weight of the emulsion composition. Higher proportions of the emulsifying agent may be used and may serve as a supplemental fuel for the composition but in general it is not necessary to add more than 5% by weight of emulsifying agent to achieve the desired effect.

If desired other, optional fuel materials, hereinafter referred to as secondary fuels, may be incorporated into the compositions of the present invention in addition to the water-immiscible organic fuel phase. Examples of such secondary fuels include finely divided solids, and water-miscible organic liquids which can be used to partially replace water as a solvent for the oxygen-releasing salts or to extend the aqueous solvent for the oxygen-releasing salts. Examples of solid secondary fuels include finely divided materials such as: sulfur; aluminium; and carbonaceous materials such as gilsonite, comminuted coke or charcoal, carbon black, resin acids such as abietic acid, sugars such as glucose or dextrose and other vegetable products such as starch, nut meal, grain meal and wood pulp.

Examples of water-miscible organic liquids include alcohols such as methanol, glycols such as ethylene glycol, amides such as formamide and amines such as methylamine.

Typically, the optional secondary fuel component of the composition of the present invention comprise from 0 to 30% by weight of the emulsion composition.

The invention is now demonstrated by, but in no way limited to, the following examples.

EXAMPLE 1 to 4

Compositions of Examples 1 to 4 were prepared by blending 90 g of "NITROPRIL"* prilled ammonium nitrate with 10 g of the asphalt emulsion characterised according to the details in Table 1.

(* NITROPRIL is a trade mark)

TABLE 1

| Example No. | Nature of Asphalt Emulsion: pH | Ratio Asphalt: Water (w/w) | Viscosity | Setting Time |
|---|---|---|---|---|
| 1 | 11–12 | 60:40 | | 3 (max) |
| 2 | 11–12 | 61:39 | | 8 min |
| 3 | 2.5–3.5 | 60:40 | 800 cp | 3 max |
| 4 | 4–5 | 66:34 | 6800 cp | — |

The oil-in-water emulsion compositions were observed to break down within about 1 to 3 minutes of being added to the solid ammonium nitrate, the water being absorbed into the prill, leaving a uniform coating of asphalt.

EXAMPLE 5

The procedure of Example 1 was repeated using an emulsion composition prepared by rapidly mixing 80% w/w emulsion composition used in preparation of the composition of Example 3 with 20% w/w of distillate.

EXAMPLE 6 to 9

The emulsion/prill blends of Examples 6 to 9 were prepared by blending parts by weight of a water-in-oil emulsion explosive having the following composition

| | Parts |
|---|---|
| Oxidizer phase | |
| ammonium nitrate | 45.20 |
| calcium nitrate | 29.61 |
| Fuel - fuel oil No. 2 | 5.2 |
| Water | 18.69 |
| Emulsifier - sorbitan monooleate | 1.30 |
| with 55 parts by weight of each of the four oil-in-water/prilled ammonium nitrate blends prepared according to the method of Examples 1 to 4 respectively. | |

COMPARATIVE EXAMPLE A

A conventional ANFO composition was prepared by adding 6% w/w distillate to "NITROPRIL" prilled ammonium nitrate of the same type as that used for the compositions of Examples 1 to 4.

COMPARATIVE EXAMPLE B

The procedure of Examples 6 to 9 was repeated except that the composition of Comparative Example A was used instead of the Compositions of Examples 1 to 4 inclusive.

EXAMPLE 10

Compositions of Examples 1 to 4 were prepared in 25 kg lots by mixing asphalt emulsions with "NITROPRIL" prilled ammonium nitrate in a concrete mixer.

A conventional ANFO composition was prepared by adding distillate to primed "NITROPRIL" ammonium nitrate.

Compositions were packaged in polyethylene film to give 130 mm×800 mm cartridges. This was also done for the composition of Comparative Example A. The cartridges were detonated using 400 Gr "Pentolite" primer in underwater energy tests with the following results.

TABLE 2

| Example No. | Comparison of "dry" explosive properties: Density (g/cc) | Bubble Energy (Mj/kg) | Shock Energy (Mj/kg) |
|---|---|---|---|
| 1 | 0.95 | 2.10 | 1.15 |
| 2 | 0.90 | 2.15 | 1.05 |
| 3 | 0.95 | 2.15 | 1.10 |
| 4 | 0.85 | 2.20 | 1.05 |
| CEA | 0.80 | 2.10 | 1.05 |

EXAMPLE 11

The degree of dissolution of ammonium nitrate in each of the compositions of Examples 1–4 and Comparative Example A on loading into water was tested using the following procedure:

50 g of product was dropped into 200 g of water and the temperature of the water was monitored.

The change in water temperature from the time of loading into the water was measured at 30 seconds, 60 seconds and 120 seconds from the time of loading and the results are tabulated in Table 2.

| Example | Time 30 Sec. (°C.) | 60 Sec. (°C.) | 120 Sec. (°C.) |
|---|---|---|---|
| 1 | 11.0 | 13.0 | 14.0 |
| 2 | 12.5 | 14.0 | 14.5 |
| 3 | 8.0 | 10.5 | 13.0 |
| 4 | 8.5 | 12.0 | 13.5 |
| 5 | 10.5 | 13.5 | 16.0 |
| CEA | 14.5 | 16.0 | 16.0 |

The rate of dissolution of ammonium nitrate from the product is indicated by the rate of temperature increase of the water. The results of the tests shown in Table 3 are plotted in FIG. 1 which indicates a significant reduction in ammonium nitrate dissolution provided by the compositions of Example 1 to 4.

EXAMPLE 12

The degree of ammonium nitrate dissolution in the compositions of Example 8 (blend prepared using the composition of Example 3), Example 9 (blend prepared using the composition of Example 4) and Comparative Example B (CEB) (a blend prepared using a conventional ANFO composition) were compared using the testing procedure of Example 11.

The change in temperature 30 seconds, 1 minute, 2 minutes, 3 minutes and 5 minutes after dropping the product, compared with the temperature at the time of dropping the product into water was calculated is shown in Table 4.

TABLE 4

| Composition Example No. | Temperature Change Time 30 Sec (°C.) | 1 min (°C.) | 2 mins (°C.) | 3 mins (°C.) | 5 mins (°C.) |
|---|---|---|---|---|---|
| 3 | 0.2 | 0.5 | 1.0 | 1.5 | 1.5 |
| 4 | 0 | 0 | 0.5 | 0.5 | 0.5 |
| CEB | 1.6 | 2.6 | 3.2 | 3.6 | 3.6 |

The results shown in Table 4 have been plotted in FIG. 2 and these results clearly indicated the reduction in ammonium nitrate dissolution in wet conditions provided by the compositions of the invention.

Comparative Example B

The procedure of Examples 6 to 9 was repeated except that the composition of Comparative Example A was used instead of the Compositions of Examples 1 to 4 inclusive.

Example 13

The extent of ammonium nitrate dissolution in wet conditions was compared for each of the products of Example 8 (blend prepared using the composition of Example 3), Example 9 (blend prepared using the composition of Example 4) and Comparative Example B (blend prepared using conventional ANFO) by the following procedure:

50 ml of the composition was placed in a 100 ml measuring cylinder filled with water and left submerged in the water for 16 days.

The amount of product remaining undissolved after 1, 2, 14 and 16 days was measured and the results are shown in Table 5 below.

TABLE 5

| Composition Example No. | Composition volume change (ml) days 0 | 2 | 3 | 14 | 16 |
|---|---|---|---|---|---|
| 8 | 50 | 49 | 49 | 49 | 47 |
| 9 | 50 | 49.5 | 49.5 | 49.5 | 47 |
| CEB | 50 | 45 | 40 | 40 | 35 |

The products of the invention showed significantly reduced dissolution under wet conditions.

Example 14

The composition of Example 9 (blend of the composition of Example 3) was tested in blasting site conditions and compared with the blasting performance of the composition of Comparative Example B.

Each product was assessed using the following procedure:

(a) The product (64 kg) was loaded into a bore hole (diameter 207 mm and depth 10.0 m) from the collar of the hole into 1.5 m of water. After loading the product, the proportion of dissolved product was determined. The results of the test are shown in Table 6.

TABLE 6

| Composition | Dissolved Product (%) |
|---|---|
| Example 9 | 22.1 |
| CEB | 55.2 |

(b) After draining water from the bottom of the borehole, samples were collected and packaged in cardboard cylinders (200 mm×800 mm). These were primed by 400 g of "Pentolite" primer and detonated and the bubble energy and shock energy produced in underwater detonation were determined for each sample. The results are shown in Table 7 below.

TABLE 7

| Composition Example No. | Density (g/ml) | Bubble Energy (MJ/Kg) | Shock Energy (MJ/Kg) |
|---|---|---|---|
| 9 | 1.30 | 1.82 | 0.68 |
| CBE | 1.31 | 1.41 | 0.37 |

(c) Freshly prepared samples of the Compositions of Example 9 and CEB were packaged and tested as detailed in part (b) and the results are detailed in Table 8 below.

TABLE 8

| Composition Example No. | Density (g/cc) | Bubble Energy (MJ/Kg) | Shock Energy (MJ/Kg) |
|---|---|---|---|
| 9 | 1.35 | 1.98 | 0.65 |
| CEB | 1.34 | 2.01 | 0.67 |

The claims defining the invention are as follows:

1. A method of preparing a particulate ammonium nitrate explosive composition comprising contacting ammonium nitrate particles with an oil-in-water emulsion wherein the discontinuous phase comprises asphalt.

2. A method according to claim 1 wherein said ammonium nitrate particles are contacted with an oil-in-water emulsion in the ratio of 100 parts of ammonium nitrate particles to from 1 to 40 parts by weight of asphalt.

3. A method according to either of claims 1 or 2 wherein said ammonium nitrate particles are contacted with an oil-in-water emulsion in the ratio of 100 parts of ammonium nitrate particles to from 1 to 20 parts by weight of asphalt.

4. A method according to any of of claims 1 to 3 wherein the oil-in-water emulsion comprises in the range of from 1 to 90% by weight of asphalt.

5. A method according to any one of claims 1 to 4 wherein the oil-in-water emulsion comprise in the range 5 to 80% by weight of said asphalt.

6. A method according to any one of claims 1 to 5 wherein the oil-in-water emulsion comprises in the range 40 to 70% by weight of said asphalt.

7. A method according to any one of claims 1 to 6 wherein the discontinuous oil phase of the oil-in-water emulsion comprises at least 50% by weight of asphalt.

8. A method according to any one of claims 1 to 7 wherein the discontinuous oil phase of the oil-in-water emulsion comprises substantially asphalt.

9. A method according to any one of claims 1 to 8 where the aqueous phase of the oil-in-water emulsion comprises an aqueous solution of at least one inorganic nitrate.

10. A method according to claim 9 wherein the inorganic nitrate is selected from the group consisting of ammonium nitrate and calcium nitrate.

11. A method according to any one of claims 1 to 10 wherein the aqueous phase of the oil-in-water emulsion comprises inorganic nitrates in the range of from 1 to 80% by weight of the oil-in-water emulsion.

12. A method according to any one of claims 1 to 11 wherein the aqueous phase of the oil-in-water emulsion comprises inorganic nitrates in the range of from 5 to 70% by weight of the oil-in-water emulsion.

13. A method according to any one of claims 1 to 12 wherein the aqueous phase of the oil-in-water emulsion comprises inorganic nitrates in the range of from 20 to 80% by weight of the oil-in-water emulsion.

14. A method according to any one of claims 1 to 13 wherein the oil-in-water emulsion comprises an emulsifying agent wherein the emulsifying agent provides an oil-in-water emulsion which emulsion remains in emulsion form until contacted with the ammonium nitrate particles.

15. An explosive composition comprising a mixture of a water-in-oil emulsion component and a particulate ammonium nitrate component characterised in that the particulate ammonium nitrate component is prepared according to the method of any one of claims 1 to 14.

16. An explosive composition according to claim 15 wherein said explosive composition comprises said particulate ammonium nitrate component in the range of from 5 to 95% by weight of the explosive composition.

17. An explosive composition according to either claim 15 or claim 16 wherein said explosive composition comprises said particulate ammonium nitrate component in the range of 30 to 80% by weight of the explosive composition.

18. An explosive composition according to any one of claims 15 to 17 wherein said explosive composition comprises said particulate ammonium nitrate component in the range of 40 to 60% by weight of the explosive composition.

19. An explosive composition according to any one of claims 15 to 18 wherein said oil-in-water emulsion component comprises a discontinuous aqueous phase comprising at least one oxygen releasing salt, a continuous water-immiscible organic phase and a water-in-oil emulsifying agent.

20. An explosive composition according to claim 19 wherein said oxygen-releasing salt is selected from the group consisting of alkali and alkaline earth metal nitrates, chlorates and perchlorates ammonium nitrate, ammonium chlorate, ammonium perchlorate and mixtures thereof.

21. An explosive composition according to claim 20 wherein said oxygen-releasing salt is selected from the group consisting of ammonium nitrate and a mixture of ammonium nitrate and sodium or calcium nitrates.

22. An explosive composition according to any one of claims 15 to 21 wherein said continuous water-immiscible organic phase is selected form the group consisting of aliphatic, alicyclic and aromatic compounds and mixtures thereof which are in the liquid state at the formulation temperature.

23. An explosive composition according to claim 22 wherein said continuous water-immiscible organic phase is selected from the group consisting of fuel oil, diesel oil, distillate, kerosene, naphtha, waxes such as microcystalline wax, paraffin wax and slack wax, paraffin oils, benzene, toluene, xylenes, polymeric oils such as the low molecular weight polymers of olefins, animal oils, fish oils, and other mineral, hydrocarbon or fatty oils, and mixtures thereof.

24. An explosive composition according to claim 23 wherein said continuous water-immiscible organic phase is selected from the group consisting of gasoline, kerosene, fuel oils and paraffin oils.

25. An explosive composition according to any of claims 15 to 24 wherein said water-in-oil emulsifying agent is selected from the group consisting of alcohol alkoxylates, phenol alkoxylates, poly(oxyalkylene) glycols, poly(oxyalkylene) fatty acid esters, amine alkoxylates, fatty acid esters of sorbiol and glycerol, fatty acid salts, sorbitan esters, poly(oxyalkylene) sorbitan esters, fatty amine alkoxylates, poly(oxyalkylene) glycol esters, fatty acid amides, fatty acid amide alkoxylates, fatty amines, quaternary amines, alkyloxazolines, alkenyloxazolines, imidazolines, alkyl-sulfonates, alkylarylsulfonates, alkylsulfosuccinates, alkylphosphates, alkenylphosphates, phosphate esters, lecithin, copolymers of poly(oxyalkylene) glycols and poly(12-hydroxystearic acid), and mixtures thereof.

26. An explosive composition according to claim 25 wherein said water-in-oil emulsifying agent is selected from the group consisting of the 2-alkyl- and 2-alkenyl-4,4'-bis (hydroxymethyl) oxazoline, the fatty acid esters of sorbitol, lecithin, copolymers of poly(oxyalkylene) glycols and poly(12-hydroxystearic acid), and mixtures thereof.

27. An explosive composition according to either of claims 25 or 26 wherein said water-in-oil emulsifying agent is selected from the group consisting of sorbitan mono-oleate, sorbitan sesquioleate, 2-oleyl-4,4,'-bis (hydroxymethyl) oxazoline, mixture of sorbitan sesquioleate, lecithin and a copolymer of poly(oxyalkylene glycol and poly (12-hydroxystearic acid), and mixtures thereof.

* * * * *